US010872717B2

(12) United States Patent
Yonezawa et al.

(10) Patent No.: US 10,872,717 B2
(45) Date of Patent: Dec. 22, 2020

(54) COMPOSITE MAGNETIC MATERIAL AND MAGNETIC CORE

(71) Applicant: TDK CORPORATION, Tokyo (JP)

(72) Inventors: Yu Yonezawa, Tokyo (JP); Yoshihiro Shinkai, Tokyo (JP)

(73) Assignee: TDK CORPORATION, Tokyo (JP)

( * ) Notice: Subject to any disclaimer, the term of this patent is extended or adjusted under 35 U.S.C. 154(b) by 423 days.

(21) Appl. No.: 16/007,485

(22) Filed: Jun. 13, 2018

(65) Prior Publication Data

US 2019/0006070 A1 Jan. 3, 2019

(30) Foreign Application Priority Data

Jun. 30, 2017 (JP) ..... 2017-128991

(51) Int. Cl.

| | |
|---|---|
| ***H01F 1/28*** | (2006.01) |
| ***H01F 3/08*** | (2006.01) |
| ***B22F 1/00*** | (2006.01) |
| ***C22C 38/10*** | (2006.01) |

(52) U.S. Cl.

CPC ..... *H01F 1/28* (2013.01); *B22F 1/0018* (2013.01); *B22F 1/0025* (2013.01); *B22F 1/0044* (2013.01); *B22F 1/0048* (2013.01); *B22F 1/0059* (2013.01); *B22F 1/0062* (2013.01); *C22C 38/10* (2013.01); *H01F 3/08* (2013.01); *B22F 2301/35* (2013.01); *B22F 2304/054* (2013.01); *B22F 2999/00* (2013.01); *C22C 2202/02* (2013.01)

(58) Field of Classification Search

CPC ..... H01F 1/28; H01F 3/08

See application file for complete search history.

(56) References Cited

U.S. PATENT DOCUMENTS 7,419,616 B2 * 9/2008 Ulicny ..... H01F 1/44 252/62.52

FOREIGN PATENT DOCUMENTS

| | | | |
|---|---|---|---|
| JP | 11-260617 | * | 9/1999 |
| JP | H11-260617 A | | 9/1999 |
| JP | 2002-105502 A | | 4/2002 |

OTHER PUBLICATIONS

Abstract for JP 2002-105502, Oct. 4, 2002.*
Translation for JP 11-260617, Sep. 24, 1999.*

* cited by examiner

*Primary Examiner* — C Melissa Koslow
(74) *Attorney, Agent, or Firm* — Oliff PLC

(57) ABSTRACT

A composite magnetic material includes a needle-like powder and a spherical powder. The needle-like powder includes a soft magnetic material and has an average minor-axis length of 100 nm or less and an average aspect ratio of 3.0 or more and 10.0 or less. The spherical powder includes a soft magnetic material and has an average major-axis length of 100 nm or less and an average aspect ratio of less than 3.0.

19 Claims, 3 Drawing Sheets

COMPOSITE MAGNETIC MATERIAL AND MAGNETIC CORE

BACKGROUND OF THE INVENTION

1. Field of the Invention

The present invention relates to a composite magnetic material and a magnetic core.

2. Description of the Related Art

In recent years, wireless communication equipment, such as mobile phones and mobile information terminals, have been used in higher frequency band, and radio signal frequency has been used in GHz band. Then, a magnetic material having a comparatively large permeability even in high-frequency region of GHz band is applied to electronic devices used in high-frequency region of GHz band so as to achieve improvement in filter characteristics and miniaturization of antenna size. It is also desired to decrease magnetic loss in high-frequency region. In this situation, attempts have been made to increase an aspect ratio or so of magnetic materials used for magnetic cores.

For example, Patent Document 1 discloses a composite material using FeSiAl-based needle-like and spherical powders, and Patent Document 2 discloses a composite material using amorphous-based needle-like and spherical powders.

At present, however, demanded is a magnetic core having a further high relative permeability μr and a further low magnetic loss tan δ.

Patent Document 1: JPH11260617 (A)

Patent Document 2: JP2002105502 (A)

SUMMARY OF THE INVENTION

It is an object of the invention to provide a composite magnetic material used for a magnetic core having a high relative permeability μr and a low magnetic loss tan δ in high-frequency region of GHz band and provide the magnetic core.

To achieve the above object, a composite magnetic material of the present invention comprises a needle-like powder and a spherical powder, wherein the needle-like powder comprises a soft magnetic material and has an average minor-axis length of 100 nm or less and a average aspect ratio of 3.0 or more and 10.0 or less, and the spherical powder comprises a soft magnetic material and has an average major-axis length of 100 nm or less and an average aspect ratio of less than 3.0.

A magnetic core containing the composite magnetic material can increase relative permeability μr and decrease magnetic loss tan δ in high frequency region.

The composite magnetic material may further comprise a resin.

The soft magnetic materials of the needle-like powder and the spherical powder may comprise a main component of Fe or Fe and Co.

A content ratio of Co to the main component may be 0 to 40 atom % (excluding 0 atom %) in the needle-like powder.

A content ratio of the needle-like powder may be 60 vol % or more and 90 vol % or less with respect to a total of the needle-like powder and the spherical powder.

The spherical powder may have an average aspect ratio of 1.5 or more and 2.5 or less.

A magnetic core of the present invention comprises the above-mentioned composite magnetic material.

A total content ratio of the needle-like powder and the spherical powder may be 35 vol % or more with respect to the entire magnetic core.

DETAILED DESCRIPTION OF THE PREFERRED EMBODIMENT

Hereinafter, the present invention is described based on an embodiment shown in the figures.

A magnetic core (core) of the present embodiment comprises a composite magnetic material containing a needle-like powder and a spherical powder.

The needle-like powder comprises a soft magnetic material and has an average minor-axis length of 100 nm or less and an average aspect ratio of 3.0 or more and 10.0 or less. Moreover, the spherical powder comprises a soft magnetic material and has an average major-axis length of 100 nm or less and an average aspect ratio of less than 3.0.

The needle-like powder has any shape, such as needle, pseudo needle, spheroid, and pseudo spheroid.

The minor-axis length, the major-axis length, and the aspect ratio of the needle-like powder are calculated by the following method. Incidentally, the minor-axis length, the major-axis length, and the aspect ratio of the spherical powder are calculated similarly.

Figure 1:
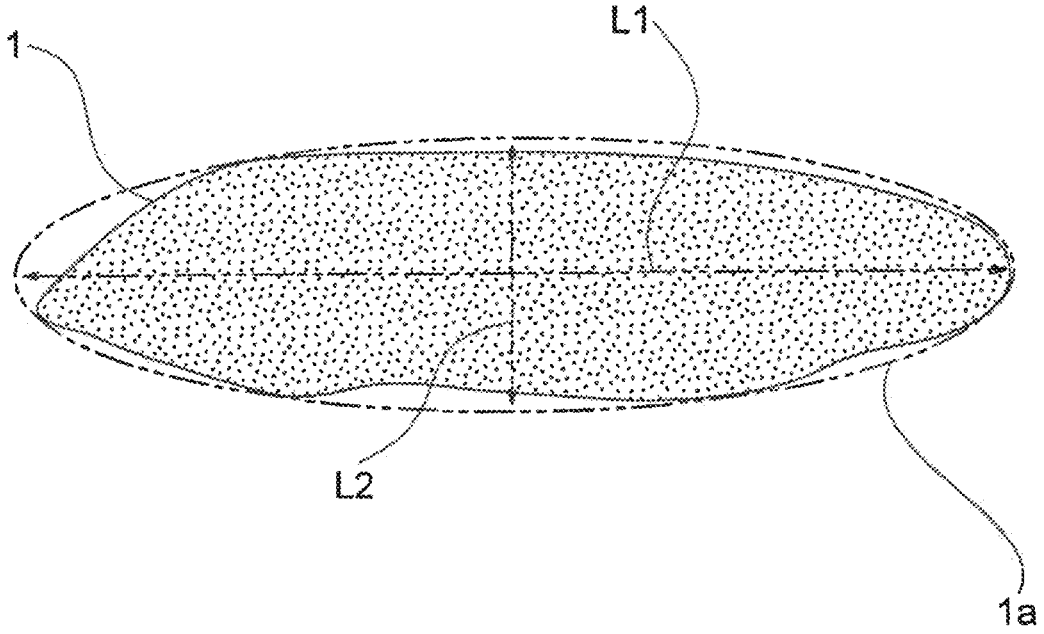
FIG. 1 is a figure showing a major-axis length and a minor-axis length of a composite magnetic material.

Initially, a two-dimensional image of a needle-like powder 1 to be measured in terms of major-axis length, minor-axis length, and aspect ratio is photographed by a SEM, a TEM, or the like. In the photographed image, an ellipse 1*a* circumscribing the needle-like powder 1 is drawn as shown in FIG. 1. The ellipse 1*a* has a major-axis length of L1 and a minor-axis length of L2. Then, L1/L2 is an aspect ratio.

The composite magnetic material of the present embodiment comprises two powders (needle-like powder and spherical powder) having different major-axis lengths, minor-axis lengths, and aspect ratios. The major-axis lengths, the minor-axis lengths, and/or the aspect ratios are within predetermined ranges. A magnetic core (core) formed by the composite magnetic material having the above-mentioned structure has an improved relative permeability μr.

Incidentally, when the needle-like powder and the spherical powder have different compositions, the powders can be distinguished based on their different compositions. When the needle-like powder and the spheric powder have the same composition, the powders can be distinguished in such a manner that a mountain having a larger aspect ratio is considered to be a needle-like powder, and that a mountain having a smaller aspect ratio is considered to be a spherical powder, in measuring and graphing a frequency distribution of an aspect ratio and having two mountains.

Preferably, the needle-like powder has an average minor-axis length of 30 nm or more and 100 nm or less. Preferably, the needle-like powder has an average aspect ratio of 4.0 or more and 10.0 or less. Preferably, the spherical powder has an average major-axis length of 80 nm or less. Preferably, the spherical powder has an average aspect ratio of 1.5 or more and 2.5 or less.

When the needle-like powder has an excessively large average minor-axis length, magnetic loss tan δ tends to be large.

The needle-like powder and the spherical powder are mixed at any ratio, but a content ratio of the needle-like powder is preferably 60 vol % or more and 90 vol % or less with respect to a total of the needle-like powder and the spherical powder.

The needle-like powder and the spherical powder are made of any materials, but preferably comprise a main component of Fe or Fe and Co. In the needle-like powder, a Co content is preferably 0 to 40 atom (excluding 0 atom %), more preferably 10 to 40 atom %, with respect to a total amount of the main component of Fe and Co.

The needle-like powder and/or the spherical powder may contain other elements of V, Cr, Mn, Cu, Zn, Ni, Mg, Ca, Sr, Ba, rare earth elements, Ti, Zr, Hf, Nb, Ta, Zn, Ga, Si, etc., and may particularly contain other elements of Al, Si, and/or Ni for improvement in oxidation resistance. The amount of other elements is not limited, but is preferably 5 mass % or less in total with respect to the whole of the needle-like powder and/or the spherical powder.

The needle-like powder and/or the spherical powder may be covered with an oxide layer. The oxide layer is composed of any type of oxide and has any thickness. For example, the oxide layer may be composed of an oxide containing one or more non-magnetic metals of Mg, Ca, Sr, Ba, rare earth elements, Ti, Zr, Hf, Nb, Ta, Zn, Al, Ga, and Si. For example, the oxide layer may have a thickness of 1.0 nm or more and 10.0 nm or less, or 1.0 nm or more and 5.0 nm or less. When the needle-like powder and/or the spherical powder is/are covered with an oxide layer, it becomes easy to prevent oxidation of the needle-like powder and/or the spherical powder.

Preferably, the needle-like powder and the spherical powder are further covered with a resin. This resin is not limited, and is an epoxy resin, a phenol resin, an acrylic resin, or the like. When the needle-like powder and the spherical powder are further covered with a resin, insulation is improved, an eddy current between the powders, which prevents magnetization rotation mentioned below, is prevented from occurring, and relative permeability μr is easily improved greatly.

The reason why a magnetic core manufactured by mixing both of the needle-like powder and the spherical powder has an improved relative permeability μr particularly in high-frequency region is considered as follows.

It is considered that the magnitude of magnetization appearing particularly in high-frequency region depends strongly on how much a precession motion of magnification in the magnetic particles is displaced. When a precession motion of magnification is displaced more greatly, magnetization to be expressed is larger, and a higher permeability is obtained.

Here, when magnetic particles having a larger shape anisotropy, that is, magnetic particles having a larger aspect ratio are used, a single magnetic domain structure is more easily self-organized due to anti-magnetic field in application of an external magnetic field.

As a result, when only a needle-like powder having a large aspect ratio is used, a precession motion of magnetization is weakened, and a relative permeability μr tends to be low. Since this needle-like powder has a homogeneous internal texture due to the self-organization, however, effective magnetization is increased, and frequency characteristics become high frequency.

On the other hand, when only a spherical powder having a small aspect ratio is used, a precession motion of magnetization is increased, and a relative permeability μr easily becomes high. Since the self-organization is hard to occur and this spherical powder has a heterogeneous internal texture, however, effective magnetization is decreased, and frequency characteristics become low frequency.

Here, when the needle-like powder and the spherical powder are mixed, the needle-like powder is preferentially self-organized. At this time, an exchange interaction is generated among the magnetic particles, and the spherical powder is also easily self-organized in the same direction as the needle-like powder. Thus, an internal texture of the spherical powder is also homogenized from the self-organization of the needle-like powder, and effective magnetization is increased. Then, frequency characteristics become high frequency.

On the contrary, the spherical powder has an increased precession motion. At this time, an exchange interaction is generated among the magnetic particles, and a precession motion of the needle-like powder is also easily increased. Thus, the precession motion of the needle-like powder is increased from the precession motion of the spherical powder. Then, relative permeability μr is increased.

When the needle-like powder and the spherical powder are mixed, the high frequency of frequency characteristics and the increase in relative permeability μr are accordingly achieved at the same time.

Incidentally, the above-mentioned effects are demonstrated insufficiently when the needle-like powder has an excessively small aspect ratio and when the spherical powder has an excessively large aspect ratio. When the needle-like powder has an excessively large aspect ratio, a magnetic core manufactured with this powder has a decreased density, and relative permeability μr is thereby decreased.

The magnetic core according to the present embodiment contains the above-mentioned composite magnetic particles. The magnetic core according to the present embodiment may be any magnetic core, such as dust core. If necessary, other compounds may be added to the composite magnetic particles in manufacturing the magnetic core. For example, a resin as a binder may be added to the composite magnetic particles. This resin may be any resin, such as epoxy resin, phenolic resin, and acrylic resin.

Preferably, a total content ratio (also referred to as a filing rate below) of the needle-like powder and the spherical powder is 35 vol % or more with respect to the entire magnetic core. When the filing rate is sufficiently high, relative permeability can be improved sufficiently.

The filling rate is calculated by any method. For example, the filling rate is calculated by the following method.

Initially, a cross section obtained by cutting the magnetic core is polished so as to manufacture an observation surface. Then, this observation surface is observed using a scanning electronic microscope (SEM), and calculated is a total area ratio of the needle-like powder and the spherical powder with respect to the entire area of the observation surface. In the present embodiment, this area ratio and the filing rate are considered to be equal, and this area ratio is considered to be the filing rate.

Described below with the figures is a method of calculating the total area ratio of the needle-like powder and the spherical powder with respect to the entire area of the observation surface.

Figure 2:
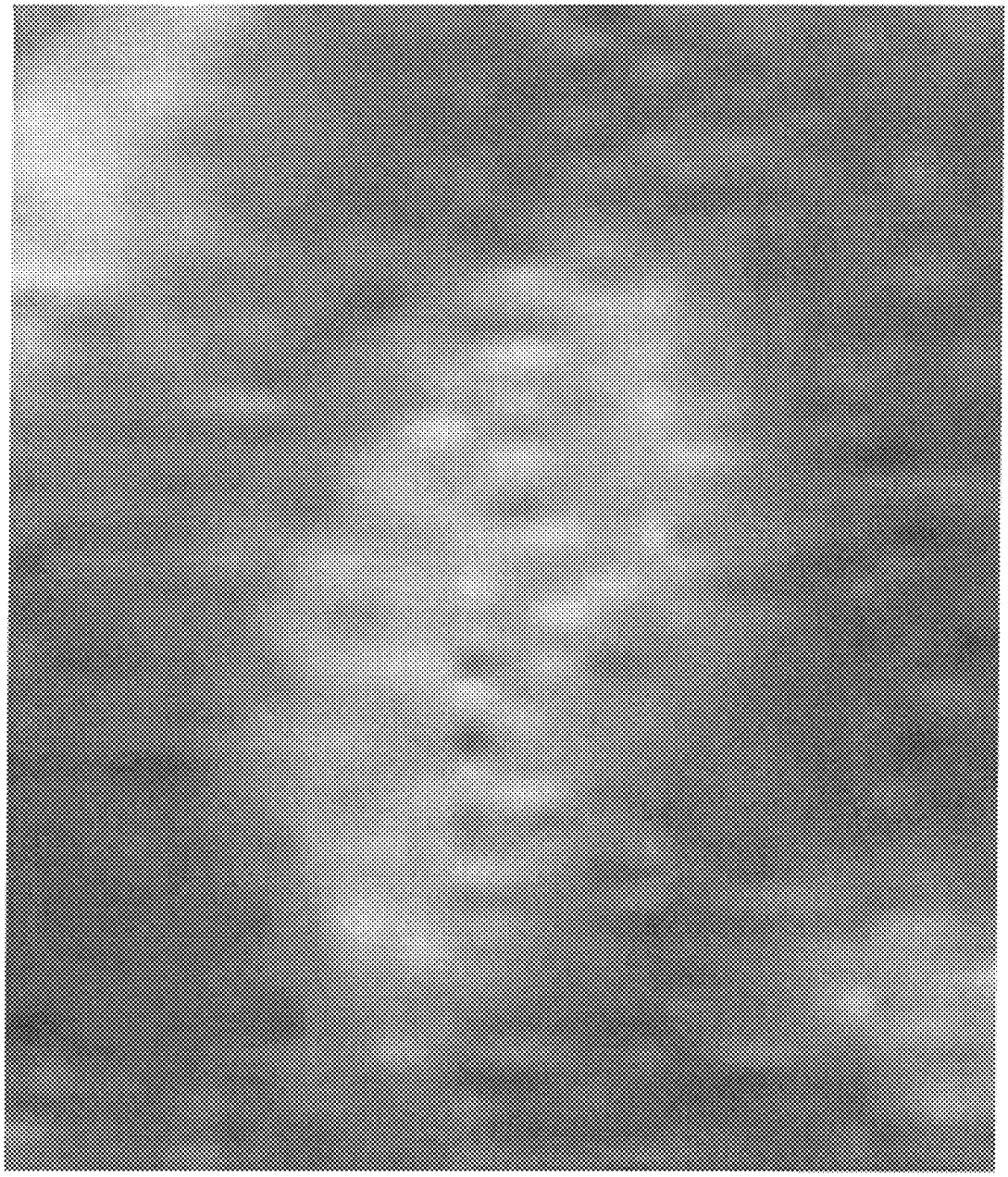
FIG. 2 is a SEM image of a cross section of a magnetic core.
Figure 3:
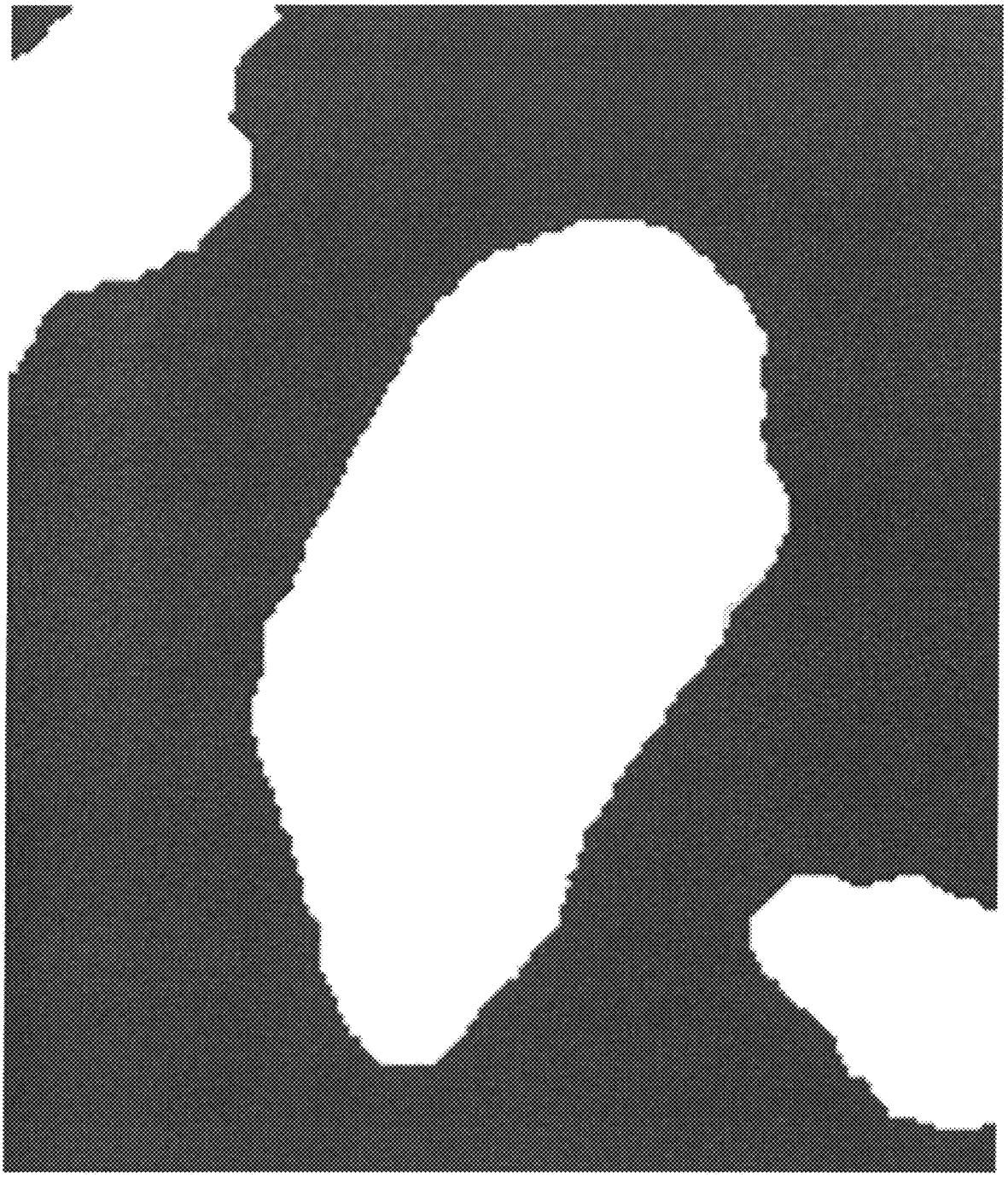
FIG. 3 is an image obtained by removing noise of FIG. 2 and binarizing it.

A SEM image obtained using a scanning electronic microscope is, for example, the image of FIG. 2. Here, the SEM image is binarized by removing noise. FIG. 3 is a result of binarizing the image of FIG. 2 by removing noise. Then, the white portions of FIG. 3 are considered to be a needle-like powder or a spherical powder, and calculated is an area ratio of the while portions with respect to the entire area of the observation surface. This area ratio is a total area ratio of the needle-like powder and the spherical powder with respect to the entire area of the observation surface.

In the calculation of the filling rate, the observation surface is considered to have a size containing 1,000 or more particles of the needle-like powder and the spherical powder in total. Incidentally, a plurality of observation surfaces may be employed, and the observation surfaces should contain 1,000 or more particles in total.

Hereinafter, the composite magnetic particles and a method of manufacturing the magnetic core according to the present embodiment are described, but are not limited to the following method.

Initially, manufactured are a needle-like powder and a spherical powder comprising a soft magnetic material having a main component of Fe or Fe and Co. The needle-like powder and the spherical powder are manufactured by any method, such as a normal method in this technical field. For example, the needle-like powder and the spherical powder may be manufactured by a known method of heating and reducing a raw material powder composed of a compound of α-FeOOH, FeO, CoO, or the like. The compositions of the needle-like powder and the spherical powder to be obtained can be determined by controlling the amount of Fe, Co, and/or other elements in the raw material powder.

Here, the average minor-axis length, the average major-axis length, and the average aspect ratio of the needle-like powder and the spherical powder can be determined by controlling the average minor-axis length and the average aspect ratio of the raw material powder. Incidentally, the method of determining the average minor-axis length, the average major-axis length, and the average aspect ratio of the needle-like powder and the spherical powder is not limited to the above-mentioned method.

When the needle-like powder and the spherical powder are covered with an oxide layer of a non-magnetic metal, there is a method where the raw material powder is added with the non-magnetic metal and is thereafter heated and reduced. The non-magnetic metal is added in the raw material powder by any method. For example, the non-magnetic metal is added in the raw material powder in such a manner that the raw material powder and a solution containing the non-magnetic metal are mixed, subjected to pH adjustment, filtered, and dried. The thickness of the oxide layer can be determined by controlling the concentration, pH, mixing time, and the like of the solution containing the non-magnetic element.

The needle-like powder and the spherical powder obtained by the above-mentioned heating and reduction are mixed with a resin and can be covered therewith. The powders are covered with the resin by any method. For example, the needle-like powder and the spherical powder can be covered with the resin in such a manner that 100 vol % of the magnetic powder is added with a solution containing 20 to 60 vol % of the resin, mixed, and dried.

Then, the needle-like powder and the spherical powder are mixed at a predetermined ratio, and the composite magnetic material according to the present embodiment can thereby be obtained.

The magnetic core is manufactured from the above-mentioned composite magnetic material by any method, such as a normal method according to the present embodiment.

For example, the needle-like powder and the spherical powder mentioned above are added with a resin and mixed, and a raw material mixture can thereby be obtained. The needle-like powder and the spherical powder are filled and pressurized in a die, and a magnetic core composed of a pressed powder can thereby be manufactured.

The magnetic core according to the present embodiment is used for any purpose, such as coil devices, LC filters, and antennas.

EXAMPLE

Next, the present invention is described in more detail based on specific examples, but is not limited to the following examples.

Initially, a magnetic powder was manufactured. The magnetic powder was manufactured by a known method of heating and reducing a powder of α-FeOOH in $H_2$.

At this time, prepared were a powder of a needle-like α-FeOOH and a powder of a spherical α-FeOOH. A needle-like powder was finally obtained from the powder of the needle-like α-FeOOH, and a spherical powder was finally obtained from the powder of the spherical α-FeOOH. The needle-like powder and the spherical powder having the minor-axis length, the major-axis length, and the aspect ratio of Table 1 were obtained by controlling the minor-axis length, the major-axis length, and the aspect ratio of the powder of the needle-like α-FeOOH and the powder of the spherical α-FeOOH.

Moreover, the compositions of the needle-like powder and the spherical powder were determined by controlling the amount of Co of the powders of α-FeOOH.

The resin shown in Table 1 was added to the needle-like powder and the spherical powder obtained by the above-mentioned method. A raw material mixture was obtained by kneading the needle-like powder and the spherical powder added with the resin at 95° C., continuing to knead them while gradually cooling them to 70° C., stop kneading them at 70° C., and rapidly cooling them to a room temperature. A total amount of the needle-like powder and the spherical powder in the magnetic core finally obtained by controlling the amount of the resin was controlled to the amount shown in FIG. 1. Incidentally the resin was JER 806: Mitsubishi Chemical, which was an epoxy resin.

Then, the raw material mixture obtained was put into a die heated to 100° C. and pressed at 980 MPa. The pressed material was thermally cured at 180° C., cut, and processed, and the magnetic cores of Examples and Comparative Examples were thereby obtained. Incidentally, the magnetic cores had a rectangular parallelopiped shape of 1 mm×1 mm×100 mm.

The relative permeability μr and the magnetic loss tan δ of the magnetic cores of Examples and Comparative Examples were measured at 2.4 GHz by a perturbation method using a network analyzer (HP 8753D manufactured by Agilent Technologies, Inc.) and a cavity resonator (manufactured by Kanto Electronic Applied Development Co., Ltd.). In the present examples, a relative permeability μr of 1.70 or more was considered to be good, a relative permeability μr of 1.80 or more was considered to be better, a relative permeability μr of 1.85 or more was considered to be better, a relative permeability μr of 1.91 or more was considered to be better, and a relative permeability μr of 2.00 or more was considered to be best. In the present examples, a magnetic loss tan δ of 0.030 or less was considered to be good. The results are shown in FIG. 1.

TABLE 1

| | needle-like powder | | | spherical powder | | | | | magnetic characteristics | |
|---|---|---|---|---|---|---|---|---|---|---|
| | composition | average minor-axis length (nm) | average aspect ratio | composition | average major-axis length (nm) | average aspect ratio | needle-like powder:spherical powder (volume ratio) | filling rate (vol %) | relative permeability μr | magnetic loss tan δ |
| Ex. 1 | Fe100 | 50 | 4.5 | Fe100 | 30 | 2.8 | 50:50 | 31 | 1.71 | 0.020 |
| Ex. 2 | Fe50Co50 | 60 | 8.0 | Fe50Co50 | 40 | 2.0 | 50:50 | 29 | 1.74 | 0.023 |
| Ex. 3 | Fe50Co50 | 60 | 8.0 | Fe100 | 30 | 2.8 | 50:50 | 30 | 1.73 | 0.024 |
| Ex. 4 | Fe50Co50 | 40 | 3.0 | Fe50Co50 | 20 | 1.2 | 50:50 | 30 | 1.72 | 0.018 |
| Ex. 5 | Fe50Co50 | 30 | 3.0 | Fe50Co50 | 90 | 1.0 | 50:50 | 30 | 1.72 | 0.025 |
| Ex. 6 | Fe50Co50 | 30 | 3.0 | Fe50Co50 | 70 | 1.2 | 50:50 | 31 | 1.74 | 0.023 |
| Ex. 7 | Fe50Co50 | 20 | 4.2 | Fe50Co50 | 40 | 1.5 | 50:50 | 31 | 1.75 | 0.016 |
| Ex. 8 | Fe50Co50 | 20 | 4.2 | Fe50Co50 | 40 | 1.5 | 50:50 | 31 | 1.73 | 0.017 |
| Ex. 9 | Fe50Co50 | 20 | 4.2 | Fe50Co50 | 40 | 1.5 | 50:50 | 31 | 1.71 | 0.018 |
| Ex. 10 | Fe50Co50 | 50 | 5.0 | Fe50Co50 | 50 | 1.7 | 50:50 | 31 | 1.76 | 0.020 |
| Ex. 11 | Fe50Co50 | 70 | 6.2 | Fe50Co50 | 30 | 2.8 | 50:50 | 30 | 1.76 | 0.022 |
| Ex. 12 | Fe50Co50 | 80 | 10.0 | Fe50Co50 | 30 | 2.8 | 50:50 | 31 | 1.73 | 0.025 |
| Ex. 13 | Fe50Co50 | 100 | 4.0 | Fe50Co50 | 50 | 1.7 | 50:50 | 32 | 1.75 | 0.027 |
| Ex. 13a | Fe60Co40 | 30 | 6.5 | Fe60Co40 | 30 | 2.6 | 50:50 | 29 | 1.79 | 0.015 |
| Ex. 14 | Fe70Co30 | 40 | 6.0 | Fe50Co50 | 30 | 2.8 | 50:50 | 30 | 1.81 | 0.017 |
| Ex. 15 | Fe70Co30 | 40 | 6.0 | Fe70Co30 | 30 | 2.8 | 50:50 | 30 | 1.83 | 0.018 |
| Ex. 16 | Fe90Co10 | 50 | 7.3 | Fe90Co10 | 40 | 2.7 | 50:50 | 30 | 1.82 | 0.020 |
| Ex. 17 | Fe70Co30 | 40 | 6.0 | Fa70Co30 | 30 | 2.8 | 60:40 | 31 | 1.85 | 0.015 |
| Ex. 18 | Fe70Co30 | 40 | 6.0 | Fe70Co30 | 30 | 2.8 | 70:30 | 31 | 1.87 | 0.014 |
| Ex. 19 | Fe70Co30 | 40 | 6.0 | Fe70Co30 | 30 | 2.8 | 80:20 | 31 | 1.90 | 0.013 |
| Ex. 20 | Fe70Co30 | 40 | 6.0 | Fe70Co30 | 30 | 2.8 | 90:10 | 30 | 1.85 | 0.016 |
| Ex. 21 | Fe70Co30 | 40 | 6.0 | Fe70Co30 | 30 | 2.8 | 80:20 | 35 | 1.95 | 0.014 |
| Ex. 22 | Fe70Co30 | 40 | 6.0 | Fe70Co30 | 30 | 2.8 | 80:20 | 38 | 1.97 | 0.018 |
| Ex. 23 | Fe70Co30 | 40 | 6.0 | Fe70Co30 | 30 | 2.4 | 80:20 | 31 | 1.92 | 0.013 |
| Ex. 24 | Fe70Co30 | 40 | 6.0 | Fe70Co30 | 30 | 2.1 | 80:20 | 30 | 1.95 | 0.013 |
| Ex. 25 | Fe70Co30 | 40 | 6.0 | Fe70Co30 | 30 | 1.8 | 80:20 | 30 | 1.96 | 0.011 |
| Ex. 26 | Fe70Co30 | 40 | 6.0 | Fe70Co30 | 30 | 1.5 | 80:20 | 31 | 1.94 | 0.010 |
| Ex. 27 | Fe70Co30 | 40 | 6.0 | Fe70Co30 | 30 | 1.8 | 80:20 | 35 | 2.00 | 0.014 |
| Ex. 28 | Fe70Co30 | 40 | 6.0 | Fe70Co30 | 30 | 1.8 | 80:20 | 37 | 2.04 | 0.015 |
| Comp. Ex. 1 | Fe50Co50 | 40 | 2.3 | Fe50Co50 | 40 | 1.2 | 50:50 | 30 | 1.67 | 0.022 |
| Comp. Ex. 2 | Fe50Co50 | 50 | 5.0 | Fe50Co50 | 120 | 3.5 | 50:50 | 27 | 1.69 | 0.040 |
| Comp. Ex. 3 | Fe50Co50 | 150 | 7.0 | Fe50Co50 | 40 | 2.8 | 50:50 | 30 | 1.53 | 0.061 |
| Comp. Ex. 4 | Fe50Co50 | 50 | 5.0 | | none | | 100:0 | 26 | 1.68 | 0.016 |
| Comp. Ex. 5 | | none | | Fe50Co50 | 40 | 2.0 | 0:100 | 28 | 1.62 | 0.019 |
| Comp. Ex. 6 | | none | | Fe50Co50 | 40 | 2.0 | 0:100 | 42 | 1.95 | 0.060 |

It is understood from Table 1 that the magnetic cores of Examples manufactured using the needle-like powders and the spherical powders within the scope of the present invention had a high relative permeability μr and a small magnetic loss tan δ.

On the other hand, the magnetic cores of Comparative Examples 1 to 6, which were out of the scope of the present invention, had a small relative permeability μr. Moreover, the magnetic cores of Comparative Examples 2, 3, and 6 had a large magnetic loss tan δ.

NUMERICAL REFERENCES

1 . . . needle-like powder
1*a* . . . ellipse (circumscribing a needle-like powder)

The invention claimed is:

1. A composite magnetic material, comprising a needle-like powder and a spherical powder, wherein the needle-like powder comprises a soft magnetic material and has an average minor-axis length of 100 nm or less and an average aspect ratio of 3.0 or more and 10.0 or less, and the spherical powder comprises a soft magnetic material and has an average major-axis length of 100 nm or less and an average aspect ratio of less than 3.0.

2. The composite magnetic material according to claim 1, further comprising a resin.

3. The composite magnetic material according to claim 1, wherein the soft magnetic materials of the needle-like powder and the spherical powder comprise a main component of Fe or Fe and Co.

4. The composite magnetic material according to claim 2, wherein the soft magnetic materials of the needle-like powder and the spherical powder comprise a main component of Fe or Fe and Co.

5. The composite magnetic material according to claim 3, wherein a content ratio of Co to the main component is 0 to 40 atom % (excluding 0 atom %) in the needle-like powder.

6. The composite magnetic material according to claim 4, wherein a content ratio of Co to the main component is 0 to 40 atom % (excluding 0 atom %) in the needle-like powder.

7. The composite magnetic material according to claim 1, wherein a content ratio of the needle-like powder is 60 vol % or more and 90 vol % or less with respect to a total of the needle-like powder and the spherical powder.

8. The composite magnetic material according to claim 2, wherein a content ratio of the needle-like powder is 60 vol % or more and 90 vol % or less with respect to a total of the needle-like powder and the spherical powder.

9. The composite magnetic material according to claim 3, wherein a content ratio of the needle-like powder is 60 vol % or more and 90 vol % or less with respect to a total of the needle-like powder and the spherical powder.

10. The composite magnetic material according to claim 5, wherein a content ratio of the needle-like powder is 60 volt % or more and 90 vol. % or less with respect to a total of the needle-like powder and the spherical powder.

11. The composite magnetic material according to claim 1, wherein the spherical powder has an average aspect ratio of 1.5 or more and 2.5 or less.

12. The composite magnetic material according to claim 2, wherein the spherical powder has an average aspect ratio of 1.5 or more and 2.5 or less.

13. The composite magnetic material according to claim 3, wherein the spherical powder has an average aspect ratio of 1.5 or more and 2.5 or less.

14. The composite magnetic material according to claim 5, wherein the spherical powder has an average aspect ratio of 1.5 or more and 2.5 or less.

15. The composite magnetic material according to claim 7, wherein the spherical powder has an average aspect ratio of 1.5 or more and 2.5 or less.

16. A magnetic core comprising the composite magnetic material according to claim 1.

17. A magnetic core comprising the composite magnetic material according to claim 2.

18. The magnetic core according to claim 16, wherein a total content ratio of the needle-like powder and the spherical powder is 35 vol % or more with respect to the entire magnetic core.

19. The magnetic core according to claim 17, wherein a total content ratio of the needle-like powder and the spherical powder is 35 vol % or more with respect to the entire magnetic core.

* * * * *